US005809979A

United States Patent [19]

Tsuda et al.

[11] Patent Number: 5,809,979

[45] Date of Patent: Sep. 22, 1998

[54] FUEL SUPPLYING DEVICE FOR ENGINE

[75] Inventors: Hiroyuki Tsuda; Kiyoharu Kimoto; Yoshio Shinno, all of Sakai, Japan

[73] Assignee: Kubota Corporation, Osaka, Japan

[21] Appl. No.: 931,471

[22] Filed: Sep. 16, 1997

[30] Foreign Application Priority Data

Feb. 10, 1997 [JP] Japan ..... 9-026817

[51] Int. Cl.[6] ..... F02M 21/02

[52] U.S. Cl. ..... 123/525; 48/144

[58] Field of Search ..... 123/525, 527; 48/144, 199 R

[56] References Cited

U.S. PATENT DOCUMENTS 3,539,313 11/1970 Phipps ..... 48/144
4,111,176 9/1978 Fenton et al. ..... 123/198 DB
4,254,064 3/1981 Bernauer et al. ..... 261/64 E
5,527,367 6/1996 Harada ..... 123/527

FOREIGN PATENT DOCUMENTS 7-103006 4/1995 Japan .

*Primary Examiner*—John T. Kwon
*Attorney, Agent, or Firm*—Bacon & Thomas, PLLC

[57] ABSTRACT

A fuel supplying device for an engine comprises a carburetor (1) having a mixing body (2) in which a venturi passage (3) is provided, a float chamber (4) being arranged in the mixing body (2), a liquid fuel nozzle (5) communicating with the float chamber (4), a liquid fuel nozzle outlet (6) facing the venturi passage (3). The mixing body (2) is provided with a gaseous fuel nozzle (7). The liquid fuel nozzle outlet (6) and a gaseous fuel nozzle outlet (8) are faced to the same venturi passage (3) so as to be able to supply the alternative of a liquid fuel or a gaseous fuel.

19 Claims, 8 Drawing Sheets

FUEL SUPPLYING DEVICE FOR ENGINE

BACKGROUND OF THE INVENTION

1. Field of the Invention

The present invention relates to a fuel supplying device for an engine.

2. Description of Prior Art

FIG. 8 shows a prior art of a fuel supplying device for an engine. This prior art comprises a carburetor 101 having a mixing body 102 in which a venturi passage 103 is provided, a float chamber 104 being arranged in the mixing body 102, a liquid fuel nozzle 105 communicating with the float chamber 104, a liquid fuel nozzle outlet 106 facing the venturi passage 103, as well as the present invention.

The prior art connects a gas mixer 134 to the carburetor 101 in series on an intake upstream side thereof and provides a gaseous fuel nozzle 107 in the gas mixer 134. A gaseous fuel nozzle outlet 108 is faced to a venturi passage 135 of the gas mixer 134 so as to be able to supply the alternative of a liquid fuel or a gaseous fuel.

The foregoing prior art has the following problems.

The venturi passage 103 of the carburetor 101 is arranged in series with the venturi passage 135 of the gas mixer 134 to produce a two-step throttling resistance, which increases an intake resistance and therefore lowers a filling efficiency of introduced air with the result of decreasing an output.

The positioning of the gas mixer 134 on the intake upstream side of the carburetor 101 disturbs an air current introduced into the venturi passage 103 of the carburetor 101 to thereby lower the accuracy of metering the liquid fuel.

The use of both the carburetor 101 and the gas mixer 134 enlarges the device.

SUMMARY OF THE INVENTION

The present invention relates to a fuel supplying device for an engine. And it has an object to provide a device capable of obtaining a high output, enhancing the accuracy of metering a liquid fuel and being made compact.

The present invention is constructed as follows.

A carburetor 1 has a mixing body 2 in which a venturi passage 3 is provided. A float chamber 4 is arranged in the mixing body 2. A liquid fuel nozzle 5 is communicated with the float chamber 4 and a liquid fuel nozzle outlet 6 is faced to the venturi passage 3.

Then the mixing body 2 is provided with a gaseous fuel nozzle 7. The liquid fuel nozzle outlet 6 and a gaseous fuel nozzle outlet 8 are faced to the same venturi passage 3 so as to be able to supply the alternative of a liquid fuel or a gaseous fuel.

The above-mentioned invention presents the following effects.

Removing the gas mixer can decrease the intake resistance and increase the air filling efficiency to result in obtaining a high output.

Since no gas mixer needs to be provided on the intake upstream side of the carburetor 1, any turbulence hardly occurs in an introduced air current flowing through the venturi passage 3 of the carburetor 1 to result in the possibility of enhancing the accuracy of metering the liquid fuel.

Necessity of no gas mixer can also make the device compact.

BRIEF DESCRIPTION OF THE DRAWINGS

FIG. 4 is a plan view of a principal part of a carburetor to be used for the first embodiment.

DESCRIPTION OF THE PREFERRED EMBODIMENTS

Embodiments of the present invention will be explained with reference to the attached drawings.

FIGS. 1 to 5 explain an engine of high tension ignition type according to a first embodiment of the present invention. This engine is constructed as follows.

Figure 5:
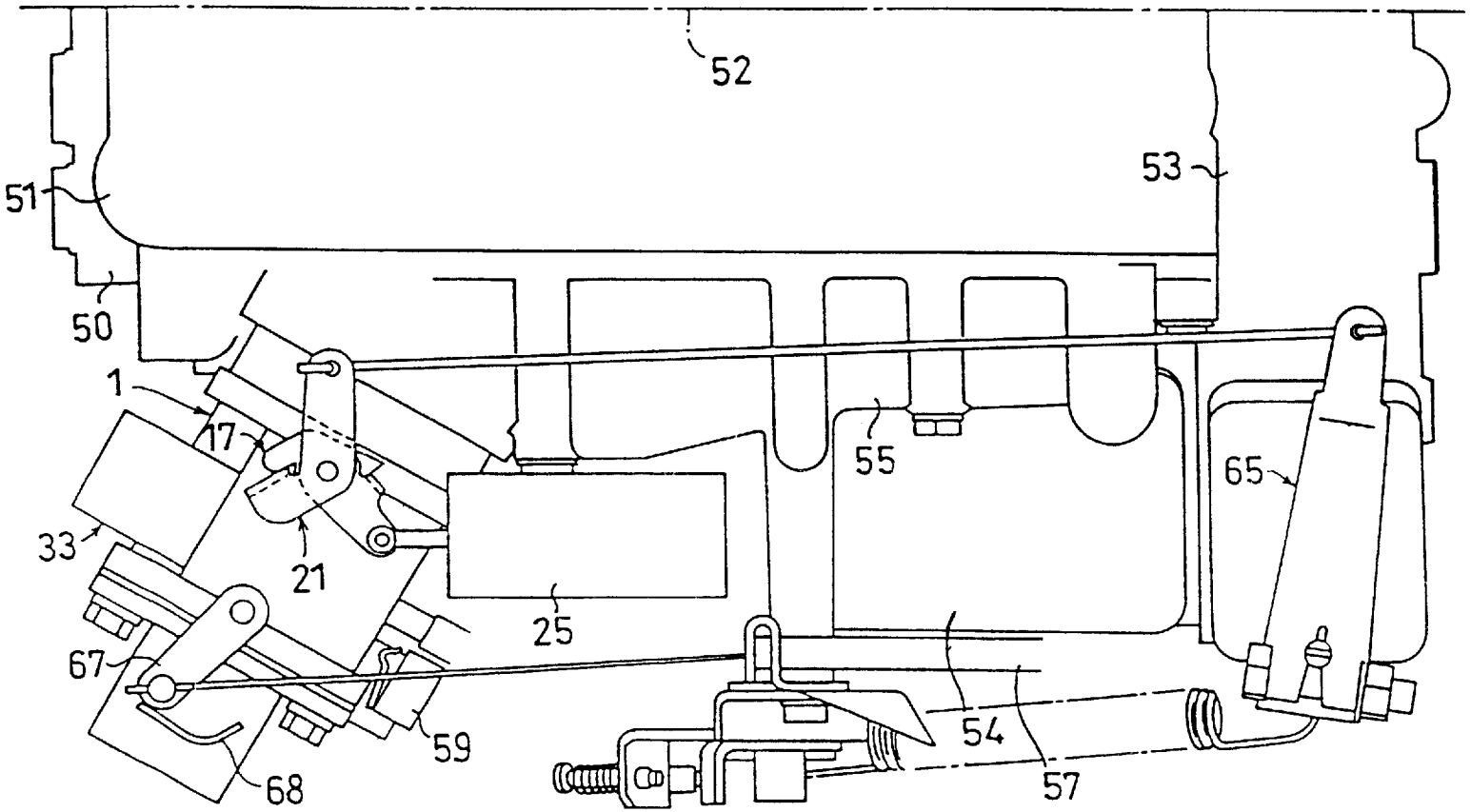
FIG. 5 is a plan view of a principal part of the engine of the first embodiment.

As shown in FIG. 5, a cylinder head 51 is assembled onto a cylinder block 50. When taking a direction of a crank axis 52 as a front and rear direction, a timing transmission case 53 is assembled to the cylinder block 50 and the cylinder head 51 in front of them. A valve gear cam case 54 is disposed on a lateral side of the cylinder block 50. The valve gear cam case 54 is connected at its front portion to the timing transmission case 53. An intake manifold 55 is assembled to a lateral side of the cylinder head 51 and a carburetor 1 is attached to a rear portion of the latter.

The carburetor 1 is constructed as follows.

Figure 1:
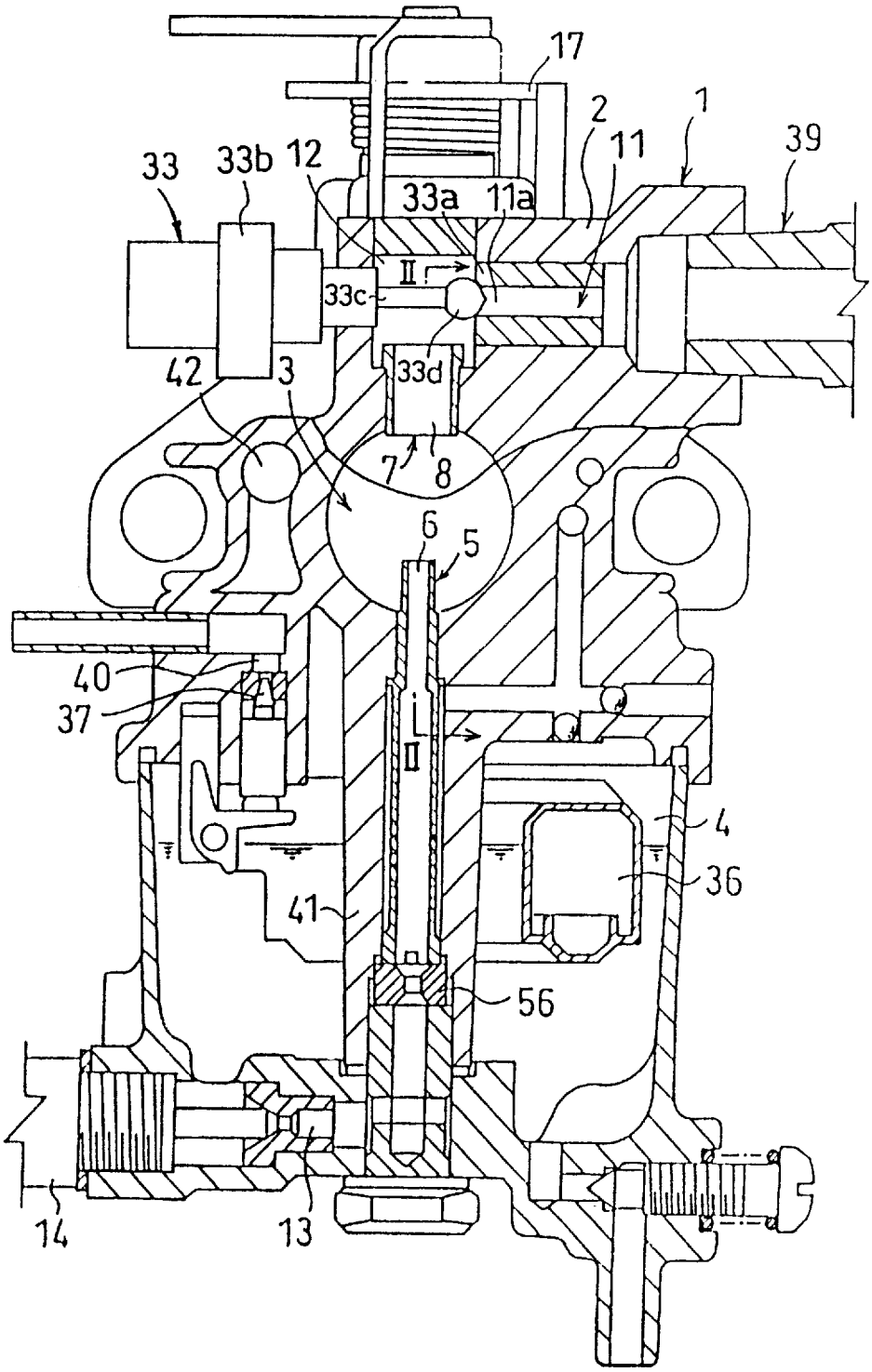
FIG. 1 is a vertical sectional view of a carburetor to be used for an engine of a first embodiment of the present invention.

As shown in FIG. 1, the carburetor 1 has a mixing body 2 in which a venturi passage 3 is provided. A float chamber 4 is arranged in the mixing body 2. A liquid fuel nozzle 5 is communicated with the float chamber 4. A liquid fuel nozzle outlet 6 is faced to the venturi passage 3.

Arranged below the mixing body 2 is the float chamber 4 accommodating a float 36 therein. A needle valve 37 mounted on the float 36 is adjusted to open or close a port 40 for supplying a liquid fuel to the float chamber 4. The mixing body 2 is provided with an air vent 42, through which an intake passage (not shown) on an intake upstream side of the mixing body 2 communicates with the float chamber 4.

Figure 2:
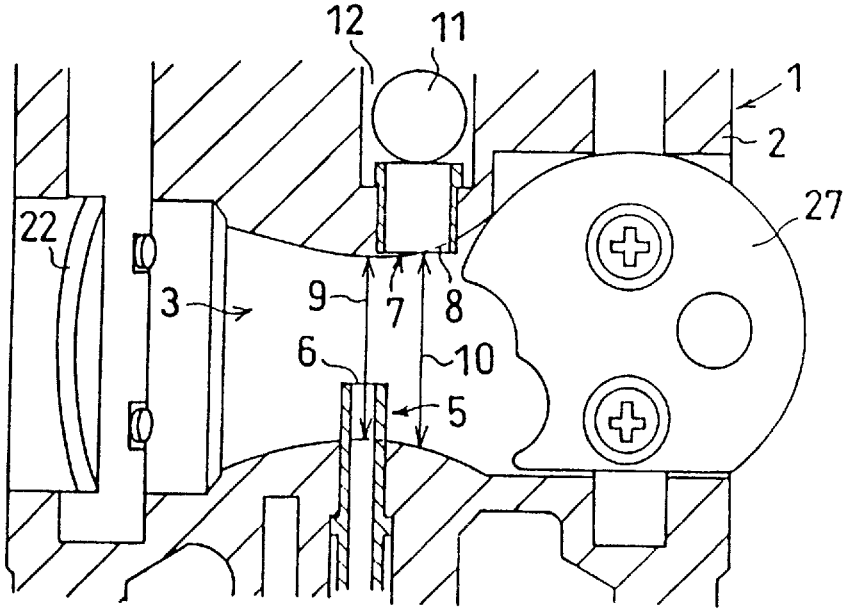
FIG. 2 is a sectional view taken along a line II—II of FIG. 1.

Vertically provided from the mixing body 2 into the float chamber 4 is a nozzle accommodating boss 41, into which a liquid fuel nozzle 5 is fitted. An upper end of the liquid fuel nozzle 5 projects into the venturi passage 3. There is arranged below the liquid fuel nozzle 5 a jet 56 for metering the liquid fuel. An inner bottom portion of the float chamber 4 is provided with a liquid fuel inlet 13, through which the float chamber 4 communicates with the liquid fuel nozzle 5. Laterally arranged at a lower portion of the float chamber 4 is a liquid fuel valve 14 for opening or closing the inlet 13. As shown in FIG. 2, the venturi passage 3 has a choke valve 27 arranged on its intake upstream side and a throttle valve 22 disposed on its intake downstream side.

In order to obtain a high output, this first embodiment provides a gaseous fuel nozzle 7 in the mixing body 2 and faces the liquid fuel nozzle outlet 6 and a gaseous fuel nozzle outlet 8 to the same venturi passage 3 so as to be able to supply the alternative of a liquid fuel or a gaseous fuel, as shown in FIG. 1. This arrangement dispenses with the gas mixer to thereby decrease an intake resistance and increase an air filling efficiency with the result of obtaining a high output. Further, it removes the provision of the gas mixer on the intake upstream side of the carburetor 1, so that any turbulence hardly occurs in an introduced air current flowing through the venturi passage 3 of the carburetor 1 to result in enhancing the accuracy of metering the liquid fuel. Additionally, necessity of no gas mixer can make the device compact.

Figure 3:
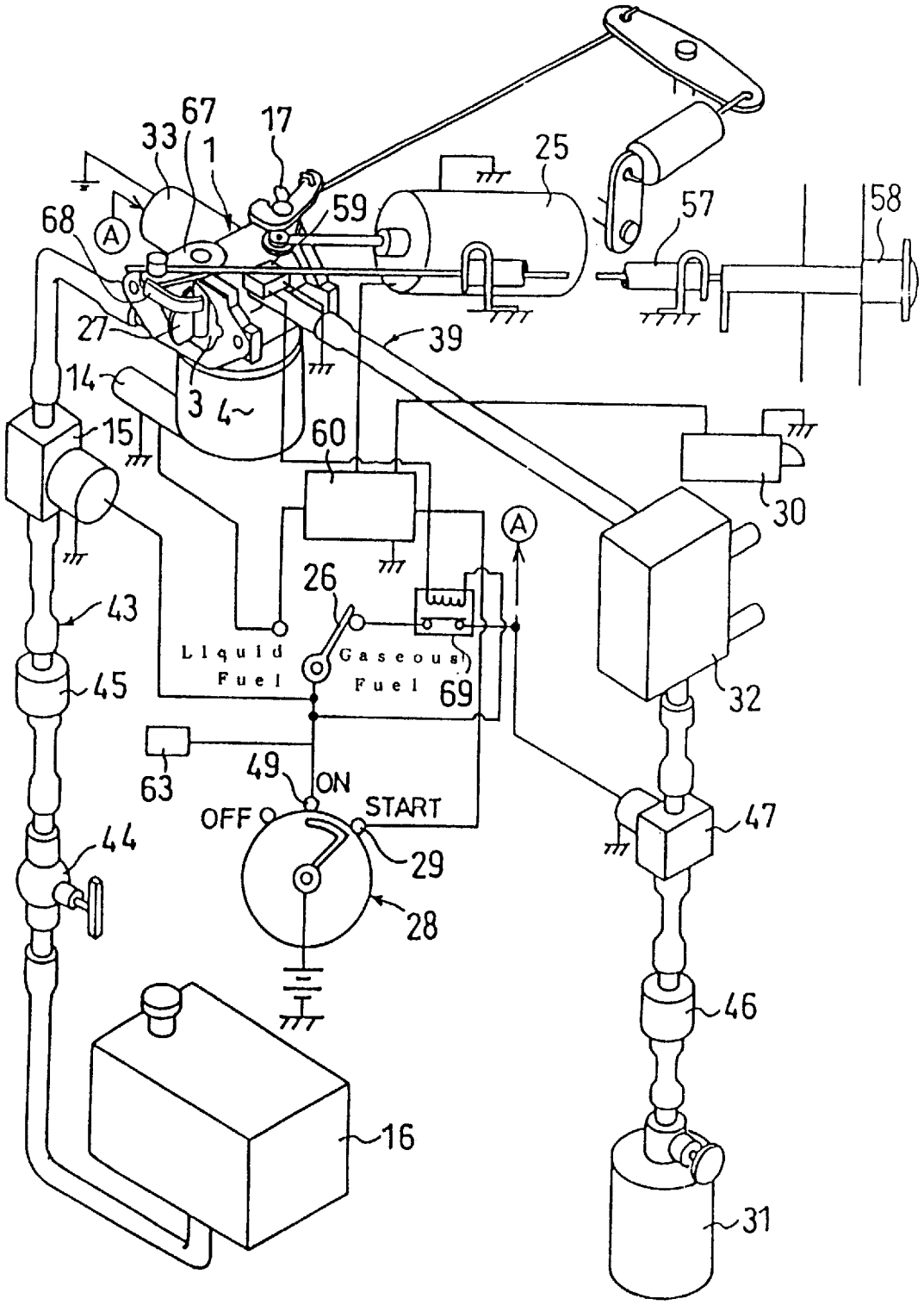
FIG. 3 is a perspective view of a fuel supplying device to be used for the first embodiment.

As shown in FIG. 3, this embodiment provides an liquid fuel supply passage 43 so as to feed the liquid fuel from a liquid fuel supply source 16 into the float chamber 4. A liquid fuel cock 44, a liquid fuel filter 45 and an electrically operated liquid fuel pump 15 are arranged in the mentioned order from the supply source 16 in the liquid fuel supply passage 43. Further, a gaseous fuel supply passage 39 is provided to feed a gaseous fuel from a gaseous fuel supply source 31 to the carburetor 1. A gaseous fuel filter 46, an upstream gaseous fuel valve 47 of electromagnetic type, a vaporizer 32 and a downstream gaseous fuel valve 33 of electromagnetic type are arranged in the mentioned order from the supply source 31 in the gaseous fuel supply passage 39.

This embodiment connects a fuel change-over means 26 to an ON position 49 of a key switch 28 as shown in FIG. 3 so as to change a gaseous fuel supply over to a liquid fuel supply or vice versa. The change-over means 26 is associated with a liquid fuel valve 14 and two gaseous fuel valves 47 and 33. In a case where with the change-over means 26 in a gaseous fuel supply state, the key switch 28 is at an engine start position 29 or the ON position 49, the two valves 47 and 33 are kept open through energizing to thereby supply the gaseous fuel to the venturi passage 3. In this case, the liquid fuel valve 14 is not energized to keep itself closed and therefore the liquid fuel is not fed to the venturi passage 3.

On the other hand, in a case where with the change-over means 26 in a liquid fuel supply state, the key switch 28 is at the engine start position 29 or the ON position 49, the liquid fuel valve 14 is kept open through energizing to thereby supply the liquid fuel to the venturi passage 3. In this case, the two valves 47 and 33 are not energized to keep themselves closed and therefore the gaseous fuel is not fed to the venturi passage 3. An ignition device 63 is connected to the ON position 49 of the key switch 28. When the key switch 28 is moved to the ON position 49 or the engine start position 29, the ignition device 63 is operated.

In order to enhance the accuracy of metering the gaseous fuel, this embodiment faces the gaseous fuel nozzle outlet 8 to a passage portion having an inner diameter 10 larger than an inner diameter 9 of a passage portion to which the liquid fuel nozzle outlet 6 is opposed, as shown in FIG. 2. This arrangement makes a negative pressure produced at the passage portion facing the nozzle outlet 8 smaller than that generated at the passage portion opposite to the nozzle outlet 6, which results in the possibility of adapting the device to a suction of a gaseous fuel small in the mass and thereby enhancing the accuracy of metering the gaseous fuel.

This embodiment has arranged the gaseous fuel nozzle outlet 8 further upstream than the liquid fuel nozzle outlet 6 in an intake direction as shown in FIG. 2 so as to inhibit the liquid fuel from stagnating in the gaseous fuel supply passage 39. Owing to this arrangement, the liquid fuel sucked into the venturi passage 3 from the nozzle 5 encounters a difficulty in entering the nozzle 7 positioned upstream in the intake direction. Thus it is hard for the liquid fuel to stagnate in the gaseous fuel supply passage 39 positioned upstream of the nozzle 7. If a large amount of liquid fuel stagnates in the gaseous fuel supply passage 39, much liquid fuel is pushed out of the supply passage 39 into the venturi passage 3 when commencing the gaseous fuel supply, flowed into a combustion chamber as it is to thereby probably cause an accident fire. However, since this embodiment makes it hard for the liquid fuel to stagnate in the gaseous fuel supply passage 39, such an accident fire can be prevented.

Figure 7:
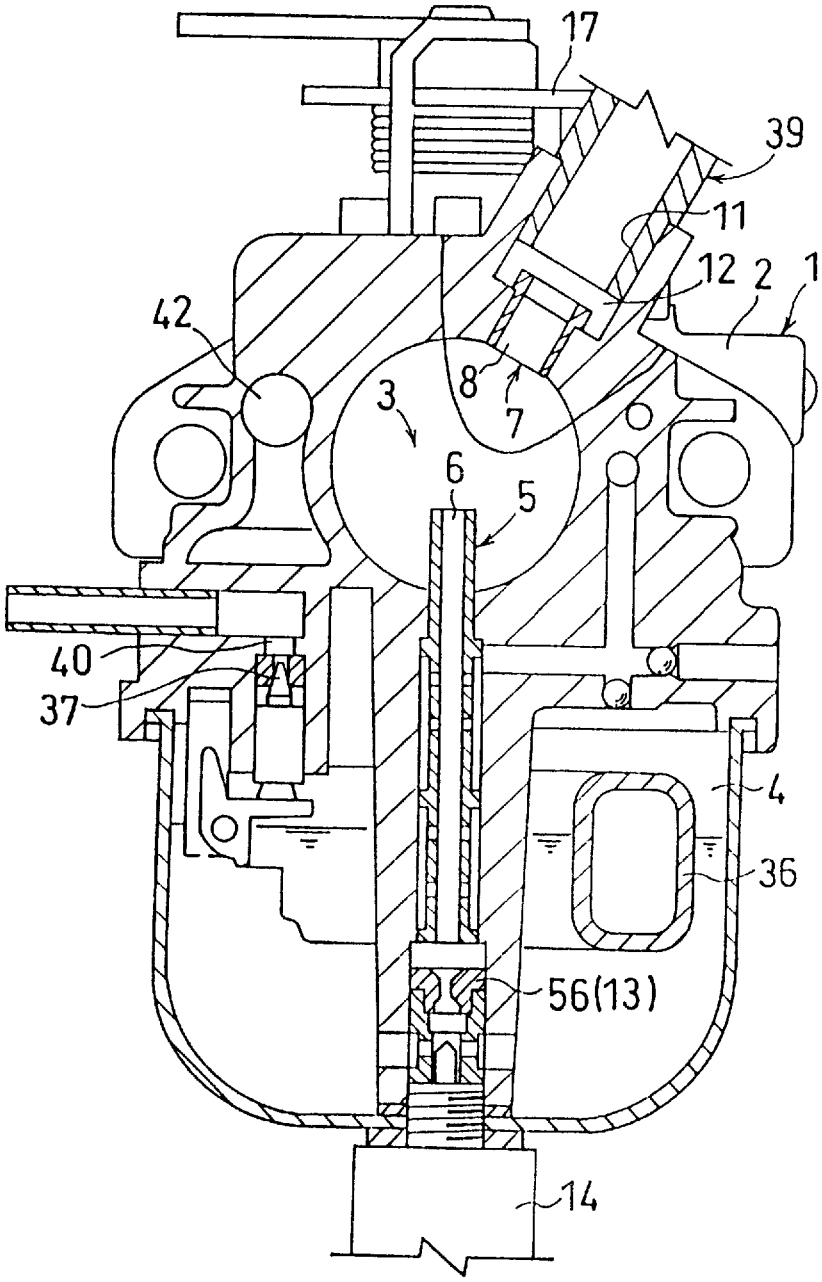
FIG. 7 is a view showing a third embodiment which corresponds to FIG. 1.
Figure 8:
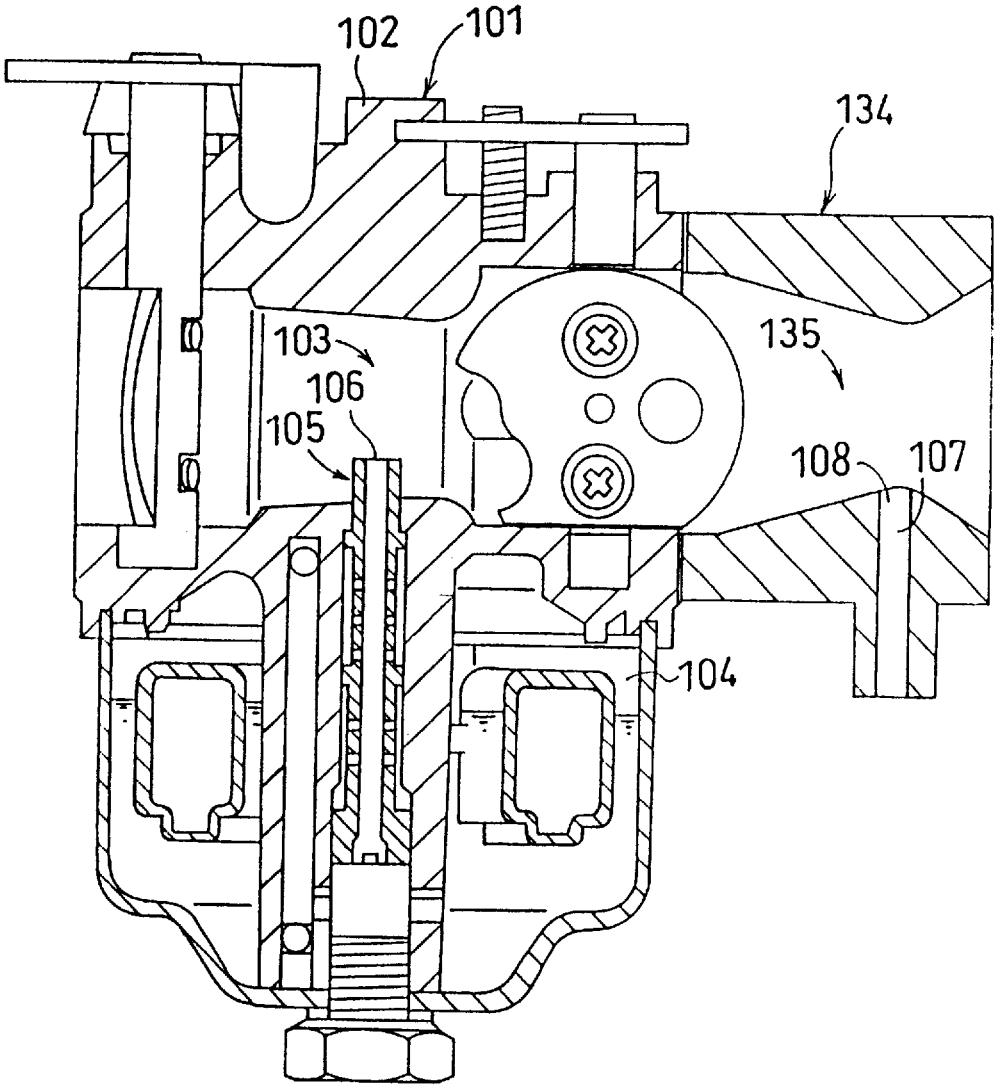
FIG. 8 PRIOR ART
FIG. 8 is a vertical sectional view of a carburetor according to a prior art.

Further, as shown in FIG. 1, the gaseous fuel nozzle 7 is directed vertically downward toward the venturi passage 3. This makes the liquid fuel adhered to an inner portion of such gaseous fuel nozzle 7 flow down into the venturi passage 3 by gravity to result in the possibility of more effectively inhibiting the liquid fuel from stagnating in the gaseous fuel supply passage 39. It is also effective to incline the nozzle 7 downward toward the venturi passage 3 like a third embodiment as shown in FIG. 7.

This first embodiment directs a gaseous fuel introduction passage 11 into the gaseous fuel nozzle 7 horizontally as shown in FIG. 1. However, the introduction passage 11 may be inclined downward toward the nozzle 7 like the third embodiment shown in FIG. 7 or directed vertically downward. This arrangement makes the liquid fuel adhered to an inner portion of the thus oriented introduction passage 11 flow down toward the nozzle 7 by gravity to thereby more effectively prevent the liquid fuel from stagnating in the gaseous fuel supply passage 39.

Besides, there is arranged an expansion chamber 12 having an imaginary gaseous fuel passage larger than the gaseous fuel nozzle 7 in sectional area between the nozzle 7 and the introduction passage 11, as shown in FIG. 1. According to this arrangement, even if an introduced air including a mist of liquid fuel enters the nozzle 7, its flow speed decreases within the expansion chamber 12 and a large mist of liquid fuel drops down by gravity to be separated from the introduced air. This can more effectively prevent the liquid fuel from stagnating in the gaseous fuel supply passage 39.

In addition, as shown in FIG. 1, the gaseous fuel introduction passage 11 is connected to the gaseous fuel nozzle 7 via the expansion chamber 12 in a bent form. Owing to this arrangement, most of the air entered from the nozzle 7 into the expansion chamber 12 passes through the expansion chamber 12 along a direction in which the nozzle 7 is formed. Therefore, the air hardly enters the introduction passage 11 connected to the nozzle 7 in the bent form to thereby more effectively inhibit the liquid fuel from stagnating in the gaseous fuel supply passage 39.

Since the expansion chamber 12 is situated at a joint portion through which the introduction passage 11 is connected to the nozzle 7 in the bent form, a resistance at the joint portion can be decreased to smoothly pass the gaseous fuel with the result of enhancing the accuracy of metering the gaseous fuel.

In order to inhibit the operation condition and the exhaust gas property from degrading when changing over to the gaseous fuel supply, as shown in FIG. 1, this first embodiment provides the liquid fuel inlet 13 between the float chamber 4 and the liquid fuel nozzle 5 and further provides the liquid fuel valve 14 for opening or closing the inlet 13.

The valve 14 is opened during the liquid fuel supply and it is closed during the gaseous fuel supply. Owing to this arrangement, when changing the liquid fuel supply over to the gaseous fuel supply, no liquid fuel is sucked into the venturi passage 3 after a small amount of liquid fuel remaining in the liquid fuel nozzle 5 having been sucked into the venturi passage 3. In consequence, the air-mixture concentration of the gaseous fuel can be optimized within a short period of time after having changed over to the gaseous fuel supply to result in the possibility of inhibiting the operation condition and the exhaust gas property from degrading.

This first embodiment operates the liquid fuel pump 15 even during the gaseous fuel supply to feed the liquid fuel from the liquid fuel supply source 16 to the float chamber 4 of the carburetor 1 as shown in FIG. 3 so as to prevent the needle valve 37 of the float 36 from wearing off. Thanks to this arrangement, as shown in FIG. 1, even if the liquid fuel within the float chamber 4 evaporates and flows out of the air vent 42 and the like, the liquid fuel pump 15 supplements the liquid fuel into the float chamber 4 and therefore the float chamber 4 is most unlikely to become empty. Should the float chamber 4 become empty, the float 36 vigorously moves up and down because of the vibration of the engine, thereby damaging the needle valve 37 of the float 36. However, this embodiment removes the likelihood that the float chamber 4 becomes empty and therefore can prevent the needle valve 37 of the float 36 from being damaged. The liquid fuel pump 15 is connected directly to the ON position 49 of the key switch 28 without bypassing the fuel change-over means 26. Thus the liquid fuel pump 15 is being operated even during the gaseous fuel supply.

In order to smoothly start the engine with the gaseous fuel, this embodiment provides a valve opening degree setting lever 17 outside the mixing body 2 and further arranges a butting portion 18 in this setting lever 17. The setting lever 17 is adjusted to be able to change from a gas start setting posture 19 to a gas start cancelling posture 20 or vice versa. When switching over the setting lever 17 to the gas start setting posture 19 and receiving a throttle input lever 21 by the butting portion 18, the throttle valve 22 takes a gas start optimum posture 24 with a predetermined opening degree 23. On the other hand, when the setting lever 17 is switched over to the gas start cancelling posture 20, the butting portion 18 is adjusted to retreat to a position where it does not interfere with the throttle input lever 21.

This arrangement can make the throttle valve 22 take the gas start optimum posture 24 with the predetermined opening degree 23 when starting the engine with the gaseous fuel. If the opening degree of the throttle valve 22 is too small when starting the engine with the gaseous fuel, an insufficient amount of air-mixture is supplied to the combustion chamber. On the other hand, if the opening degree of the throttle valve is too large, there is caused a case where the concentration of the air-mixture to be supplied to the combustion chamber becomes too thin to smoothly start the engine. However, this embodiment can place the throttle valve 22 in the gas start optimum posture 24, so that it is possible to smoothly start the engine with the gaseous fuel.

Further, when the valve opening degree setting lever 17 is switched over to the gas start cancelling posture 20 after the engine start with the gaseous fuel has finished, the butting portion 18 retreats to the position where it does not interfere with the throttle input lever 21. Consequently, the valve opening degree setting lever 17 does not disturb the movement of the throttle valve 22 during the normal operation with the gaseous fuel as well as when starting or normally operating the engine with the liquid fuel. In other words, it is possible to open or close the throttle valve 22 over a whole range.

This embodiment adjusts the butting portion 18 so as to receive the throttle input lever 21 trying to rotate in a direction for totally opening the throttle valve 22. When a speed controlling means 64 is operated to a high speed side H, the throttle input lever 21 is urged toward the direction for totally opening the throttle valve 22 through a force 62 of a governor spring 61 of a mechanical governor 65. The opening degree 23 for placing the throttle valve 22 in the gas start optimum posture 24 is set depending on an engine adopting this carburetor 1. In this embodiment, the opening degree of the completely closed posture of the throttle valve 22 is set to 0 degrees and that of the totally opened posture, to 90 degrees. Further, the above-mentioned opening degree 23 is set to 30 degrees.

In order to start the engine with the gaseous fuel by a simple operation, this embodiment interlockingly connects the valve opening degree setting lever 17 to an electrically operated actuator 25 as shown in FIG. 3. With the fuel change-over means 26 in the gaseous fuel supply state and the opening degree of the choke valve 27 being not less than a predetermined value, when the key switch 28 is moved to the engine start position 29, a starter 30 and the actuator 25 are adjusted to operate to place the setting lever 17 in the gas start setting posture 19. This adjustment can operate the starter 30 and the actuator 25 only by moving the key switch 28 to the engine start position 29 when the engine start with the gaseous fuel is proper or when the opening degree of the choke valve 27 is not less than the predetermined value. Thus it is possible to easily start the engine with the gaseous fuel.

In this embodiment, when the key switch 28 is moved from the engine start position 29 to the ON position 49, the starter 30 stops and the actuator 25 returns the valve opening degree setting lever 17 to the gas start cancelling posture 20 after an elapse of a predetermined set time. As shown in FIG. 3, the fuel change-over means 26 and the engine start position 29 of the key switch 28 are interlocked to the starter 30 and the actuator 25 through a control means 60 to effect the foregoing control. A microcomputer is employed for the control means 60.

In order not to start the engine when the engine start with the gaseous fuel is improper, as shown in FIG. 3, with the fuel change-over means 26 in the gaseous fuel supply state and the opening degree of the choke valve 27 being below the predetermined value, this embodiment does not operate the starter 30 even if the key switch 28 is moved to the engine start position 29. This arrangement does not operate the starter 30 and therefore cannot start the engine when the engine start with the gaseous fuel is improper or when the opening degree of the choke valve 27 is below the predetermined value. Should the gaseous fuel start the engine with the opening degree of the choke valve 27 being below the predetermined value, there is a fear that the air-mixture of the gaseous fuel becomes so thick that it degrades the exhaust gas property. But this embodiment does not operate the starter 30 when the opening degree of the choke valve 27 is below the predetermined value. Therefore, it can prevent the exhaust gas property from degrading and at the same time warn an operator that the opening degree of the choke valve 27 is inappropriate. Such a control is performed by the control means 60.

In order to smoothly start the engine with the liquid fuel, with the fuel change-over means 26 in the liquid fuel supply state, this embodiment operates the starter 30 but it does not operate the actuator 25 when the key switch 28 is moved to the engine start position 29, thereby maintaining the valve opening degree setting lever 17 in the gas start cancelling posture 20, as shown in FIG. 3.

Figure 4B:
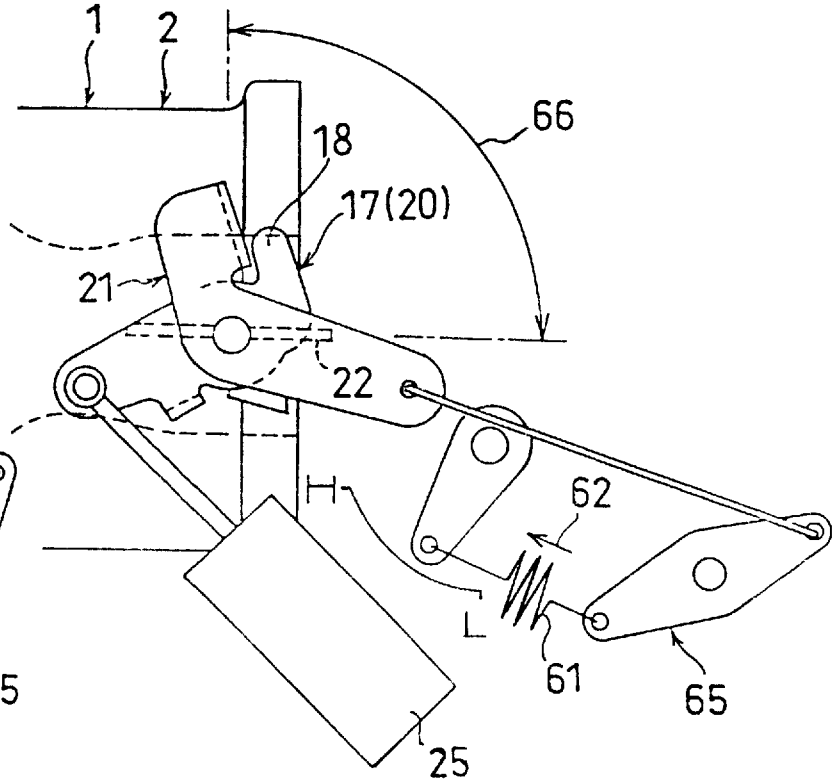
FIG. 4(B) is a view showing the valve opening degree setting lever in a posture for cancelling the gas start.
Figure 4A:
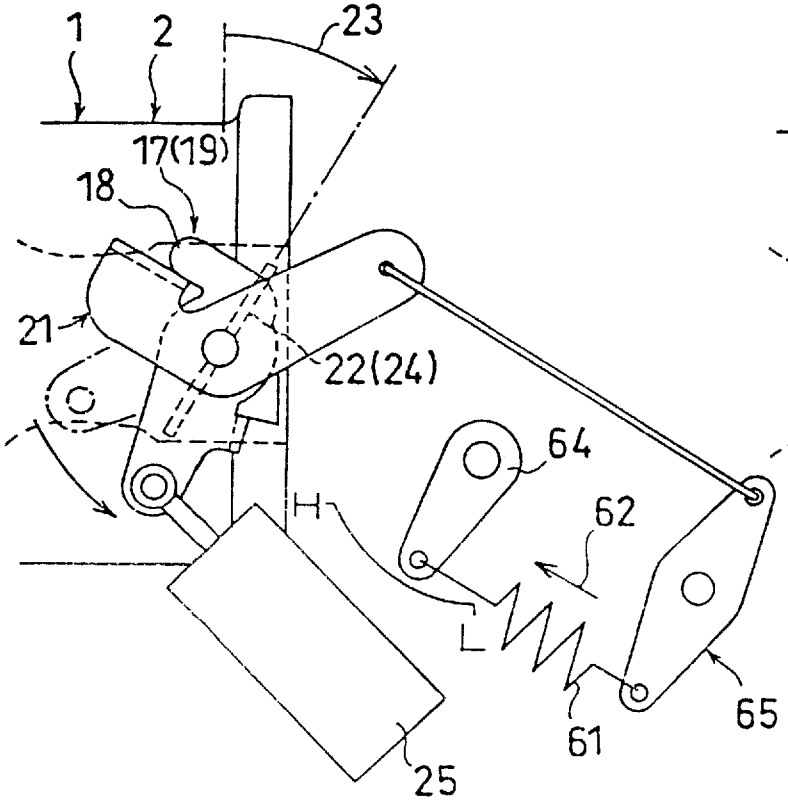
FIG. 4(A) is a view showing a valve opening degree setting lever in a posture for setting gas start.

This arrangement keeps the setting lever 17 in the gas start cancelling posture 20 at the time of starting the engine with the liquid fuel as shown in FIG. 4 to result in the possibility of smoothly starting the engine with the liquid fuel without disturbing the supply of the air-mixture of the liquid fuel to the combustion chamber by the opening limit of the throttle valve 22. The control means 60 performs such a control.

This embodiment provides the gaseous fuel valve 33 downstream of the vaporizer 32 for gasifying a fuel from the gaseous fuel supply source 31 and feeding the gasified fuel to the gaseous fuel nozzle 7 as shown in FIG. 3, and it further opens the gaseous fuel valve 33 during the gaseous fuel supply but closes the same during the liquid fuel supply so as to optimize the air-mixture concentration of the liquid fuel within a short period of time when changed over to the liquid fuel supply. This arrangement removes a likelihood that the gaseous fuel is sucked into the venturi passage 3 after a small amount of gaseous fuel remaining downstream of the gaseous fuel valve 33 having been sucked into the venturi passage 3 when the gaseous fuel supply is changed over to the liquid fuel supply. Consequently, it is possible to optimize the air-mixture concentration of the liquid fuel within a short period of time after having been changed over to the liquid fuel supply and inhibit the operation condition and the exhaust gas property from degrading. In addition, even if the choke valve 27 is about to be completely closed when starting the engine with the liquid fuel, the gaseous fuel valve 33 is closed and therefore a large negative pressure produced in the venturi passage 3 does not influence on the vaporizer 32, which prevents a diaphragm or the like arranged within the vaporizer 32 from being damaged. The control means 60 conducts such a control.

This embodiment attaches the gaseous fuel valve 33 to the mixing body 2 so as to optimize the air-mixture concentration of the liquid fuel within a short period of time after having been changed over to the liquid fuel supply. The vaporizer 32 is equipped with a pressure regulating portion and serves also as a regulator.

According to the above construction, when the gaseous fuel supply is changed over to the liquid fuel supply, the gaseous fuel is not sucked into the venturi passage 3 after an extremely small amount of gaseous fuel remaining downstream of the gaseous fuel valve 33 having been sucked into the venturi passage 3. Consequently, the air-mixture concentration of the liquid fuel can be optimized within a short period of time after having changed over to the liquid fuel supply, so that the operation condition can be prevented from degrading as well as the exhaust gas property. Moreover, there is hardly occurred a failure to mount the gaseous fuel valve 33 within the gaseous fuel supply passage 39.

In order to prevent the liquid fuel from stagnating in the gaseous fuel supply passage 39, this first embodiments directs the gaseous fuel nozzle 7 downward toward the venturi passage 3 and provides in the mixing body 2 the gaseous fuel introduction passage 11 for introducing the gaseous fuel from the vaporizer 32 to the gaseous fuel supply nozzle 7. Further, it provides above the gaseous fuel nozzle 7 the expansion chamber 12 having an imaginary gaseous fuel passage larger than the gaseous fuel nozzle 7 in sectional area, which communicates the gaseous fuel introduction passage 11 with the gaseous fuel nozzle 7. A seat 33*a* of the gaseous fuel valve 33 is arranged in an outlet 11*a* of the gaseous fuel introduction passage 11, which outlet 11*a* faces the expansion chamber 12.

According to the above construction, the expansion chamber 12 being provided above the gaseous fuel nozzle 7, even if the introduced air including the liquid fuel enters the gaseous fuel nozzle 7 during the liquid fuel supply, the flow speed of this air decreases within the expansion chamber 12 and large liquid drops fall down by gravity. And these falling down liquid drops return to the venturi passage 3 through the downwardly directed nozzle 7. Further, since the seat 33*a* of the gaseous fuel valve 33 is arranged in the outlet 11*a* of the gaseous fuel introduction passage 11, the liquid fuel does not enter the introduction passage 11. Therefore, the liquid fuel scarcely stagnates in the gaseous fuel supply passage 39 while being supplied. If the liquid fuel stagnates in the supply passage 39, the stagnating liquid fuel is pushed out of the supply passage 39 into the venturi passage 3 when commencing the gaseous fuel supply, and flowed into the combustion chamber as it is to lead to a likelihood of causing an accident fire. The present invention hardly causes the liquid fuel to stagnate in the gaseous fuel supply passage 39 to result in the possibility of preventing such an accident fire from happening.

This embodiment constructs the gaseous fuel valve 33 from a linear actuator 33*b*, a valve body 33*d* attached to a front end of an output rod 33*c* of the linear actuator 33*b* and the valve seat 33*a*. The linear actuator 33*b* reciprocates the valve body 33*d* within the expansion chamber 12 to open or close the gaseous fuel valve 33. According to this construction, the expansion chamber 12 can be effectively used as a valve chamber, which in turn can attach the gaseous fuel valve 33 to the carburetor 1 compactly.

This embodiment is constructed as follows so as not to start the engine if the engine start with the gaseous fuel is improper.

As shown in FIG. 3, in a case where the choke valve 27 has an opening degree not less than the predetermined value to take an almost totally opened posture with the fuel change-over means 26 in the gaseous fuel supply state, the gaseous fuel valve 33 is adjusted to be opened. On the other hand, provided that the choke valve 27 has an opening degree below the predetermined value to take an almost completely closed posture even with the fuel change-over means 26 in the gaseous fuel supply state, the gaseous fuel valve 33 is adjusted to be closed. As the opening degree of the choke valve 27 has a larger value, the choke valve 27 comes closer to the totally opened posture.

According to the above construction, when the engine start with the gaseous fuel is improper or when the choke valve 27 has an opening degree below the predetermined value to take an almost completely closed posture, the gaseous fuel valve 33 is closed to make the engine start impossible. Should the engine be started with the gaseous fuel while the choke valve 27 is being almost completely closed, the air-mixture concentration of the gaseous fuel becomes so thick that it causes a likelihood of degrading the exhaust gas property. However, since this embodiment does not start the engine with the choke valve 27 almost closed, it can prevent the exhaust gas property from degrading and at the same time warn the operator that the posture of the choke valve 27 is improper.

As shown in FIG. 3, the choke valve 27 is interlockingly connected to a choke valve operating member 58 through a push-pull wire 57 and its input arm 67 is provided with a pushing piece 68, to which a means 59 for detecting the opening degree of the choke valve 27 is opposed. Depending on whether or not the pushing piece 68 contacts with the detecting means 59, the present invention can detect the opening degree of the choke valve 27 is either not less than or below the predetermined value. The fuel change-over means 26 is provided with a relay 69, which is associated with the detecting means 59. When the detecting means 59 detects the opening degree of the choke valve 27 to be below the predetermined value, the relay 69 becomes OFF to deenergize the gaseous fuel valves 47 and 33 even with the fuel change-over means 26 in the gaseous fuel supply state and therefore keep them closed.

This embodiment attaches to the mixing body 2 the gaseous fuel valve 33 and the means 59 for detecting the opening degree of the choke valve 27. Consequently, it is very seldom to fail to attach them.

Figure 6:
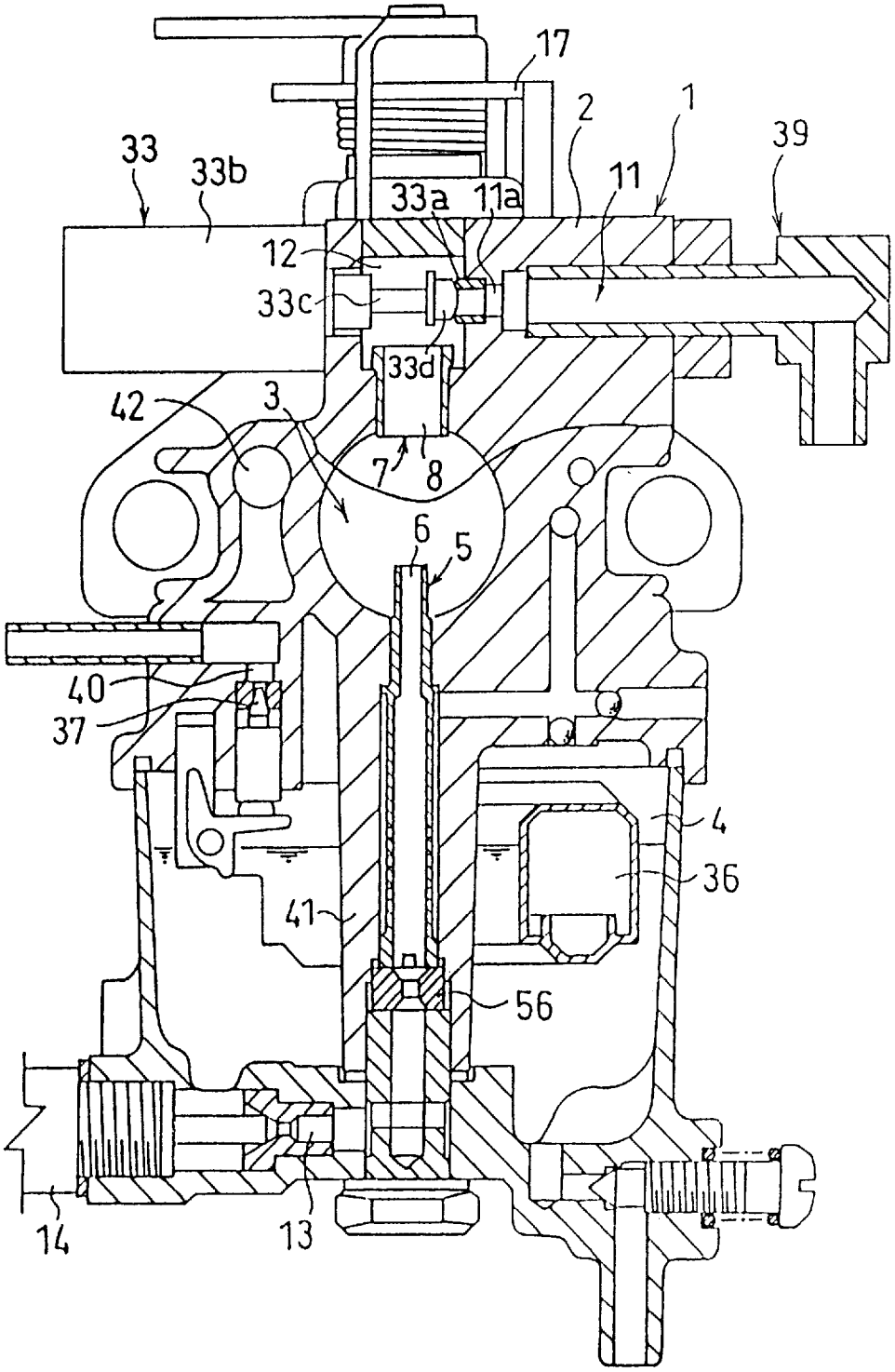
FIG. 6 is a view showing a second embodiment which corresponds to FIG. 1.

A second embodiment shown in FIG. 6 has the same construction as that of the first embodiment except that the downstream gaseous fuel valve 33 and the gaseous fuel supply passage 39 are different from those of the first embodiment in shape. In FIG. 6, the same elements as those of the first embodiment are designated by the same numerals.

A third embodiment shown in FIG. 7 inclines the gaseous fuel nozzle 7 downward toward the venturi passage 3 and slants the gaseous fuel introduction passage 11 downward toward the nozzle 7. It further connects the introduction passage 11 to the nozzle 7 straightly through the expansion chamber 12. Besides, the liquid fuel metering jet 56 accommodated within the nozzle accommodating boss 41 is adjusted to serve also as the liquid fuel inlet 13. The liquid fuel valve 14 for opening or closing the inlet 13 is arranged vertically at a lower portion of the float chamber 4. A downstream gas valve (not shown) is provided at a half-way portion of the gaseous fuel supply passage 39. The other construction is the same as that of the first embodiment. In FIG. 7, the same elements as those of the first embodiment are designated by the same numerals.

What is claimed is:

1. A fuel supplying device for an engine, comprising a carburetor (1) having a mixing body (2) in which a venturi passage (3) is provided, a float chamber (4) being arranged in the mixing body (2), a liquid fuel nozzle (5) communicating with the float chamber (4), a liquid fuel nozzle outlet (6) facing the venturi passage (3), wherein the mixing body (2) is provided with a gaseous fuel nozzle (7), the liquid fuel nozzle outlet (6) and a gaseous fuel nozzle outlet (8) facing the same venturi passage (3) so as to be able to supply the alternative of a liquid fuel or a gaseous fuel.

2. A fuel supplying device as set forth in claim 1, wherein the gaseous fuel nozzle outlet (8) faces a passage portion having an inner diameter (10) larger than an inner diameter (9) of a passage portion opposed to the liquid fuel nozzle outlet (6).

3. A fuel supplying device as set forth in claim 1, wherein the gaseous fuel nozzle outlet (8) is arranged further upstream than the liquid fuel nozzle outlet (6) in a intake direction.

4. A fuel supplying device as set forth in claim 1, wherein the gaseous fuel nozzle (7) is directed vertically downward or inclined downward toward the venturi passage (3).

5. A fuel supplying device as set forth in claim 1, wherein an gaseous fuel introduction passage (11) into the gaseous fuel nozzle (7) is inclined downward or directed vertically downward toward the gaseous fuel nozzle (7).

6. A fuel supplying device as set forth in claim 1, wherein there is arranged between the gaseous fuel nozzle (7) and a gaseous fuel introduction passage (11) an expansion chamber (12) having an imaginary gaseous fuel passage larger than the gaseous fuel nozzle (7) in sectional area.

7. A fuel supplying device as set forth in claim 6, wherein the expansion chamber (12) connects the gaseous fuel introduction passage (11) to the gaseous fuel nozzle (7) in a bent form.

8. A fuel supplying device as set forth in claim 1, wherein a liquid fuel inlet (13) is provided between the float chamber (4) and the liquid fuel nozzle (5) and a liquid fuel valve (14) for opening or closing the inlet (13) is also provided, the liquid fuel valve (14) being opened during a liquid fuel supply and it being closed during a gaseous fuel supply.

9. A fuel supplying device as set forth in claim 8, wherein a liquid fuel pump (15) is operated even during the gaseous fuel supply so as to feed a liquid fuel from a liquid fuel supply source (16) to the float chamber (4) of the carburetor (1).

10. A fuel supplying device as set forth in claim 1, wherein a valve opening degree setting lever (17) is arranged outside the mixing body (2) and provided with a butting portion (18) so as to switch over the setting lever (17) from a gas start setting posture (19) to a gas start cancelling posture (20) or vice versa, a throttle valve (22) being placed in a gas start optimum posture (24) with a predetermined opening degree (23) when switching over the setting lever (17) to the gas start setting posture (19) and receiving a throttle input lever (21) by the butting portion (18) and on the other hand the butting portion (18) retreating to a position where it does not interfere with the throttle input lever (21) when switching over the setting lever (17) to the gas start cancelling posture (20).

11. A fuel supplying device as set forth in claim 10, wherein the valve opening degree setting lever (17) is interlockingly connected to an electrically operated actuator (25), with a fuel change-over means (26) in a gaseous fuel supply state and an opening degree of a choke valve (27) being not less than a predetermined value, a starter (30) and the actuator (25) being operated to place the setting lever (17) in the gas start setting posture (19) when a key switch (28) is moved to an engine start position (29).

12. A fuel supplying device as set forth in claim 11, wherein with the fuel change-over means (26) in the gaseous fuel supply state and an opening degree of the choke valve (27) being below the predetermined value, the starter (30) is not operated even when the key switch (28) is moved to the engine start position (29).

13. A fuel supplying device as set forth in claim 11, wherein with the fuel change-over means (26) in a liquid fuel supply state, when the key switch (28) is moved to the engine start position (29), the starter (30) is operated but the actuator (25) is not operated to thereby maintain the valve opening degree setting lever (17) in the gas start cancelling posture (20).

14. A fuel supplying device as set forth in claim 1, wherein a gaseous fuel valve (33) is arranged downstream of a vaporizer (32) for gasifying a fuel from a gaseous fuel supply source (31) and feeding the gasified fuel to the gaseous fuel nozzle (7), the gaseous fuel valve (33) being opened during a gaseous fuel supply but it being closed during a liquid fuel supply.

15. A fuel supplying device as set forth in claim 14, wherein the gaseous fuel valve (33) is attached to the mixing body (2).

16. A fuel supplying device as set forth in claim 15, wherein the gaseous fuel nozzle (7) is directed downward toward the venturi passage (3), the mixing body (2) being provided with a gaseous fuel introduction passage (11) for introducing the gaseous fuel from the vaporizer (32) into the gaseous fuel nozzle (7), there being arranged above the gaseous fuel nozzle (7) an expansion chamber (12) having an imaginary gaseous fuel passage larger than the gaseous fuel nozzle (7) in sectional area, which communicates the introduction passage (11) with the nozzle (7), a valve seat (33*a*) being arranged in an outlet (11*a*) of the gaseous fuel introduction passage (11).

17. A fuel supplying device as set forth in claim 15, wherein the gaseous fuel valve (33) is constructed from a linear actuator (33*b*), a valve body (33*d*) attached to a front end of an output rod (33*c*) of the linear actuator (33*b*) and the valve seat (33*a*), the linear actuator (33*b*) reciprocating the valve body (33*d*) within the expansion chamber (12) so as to open or close the gaseous fuel valve (33).

18. A fuel supplying device as set forth in claim 14, wherein the gaseous fuel valve (33) is opened when a choke valve (27) has an opening degree not less than a predetermined value to take an almost totally opened posture with a fuel change-over means (26) in a gaseous fuel supply state and it is closed when the choke valve (27) has an opening degree below the predetermined value to take an almost completely closed posture even with the fuel change-over means (26) in the gaseous fuel supply state.

19. A fuel supplying device as set forth in claim 18, wherein the gaseous fuel valve (33) and a means (59) for detecting the opening degree of the choke valve (27) are attached to the mixing body. (2).

* * * * *